US007783208B2

(12) United States Patent
Shiroki et al.

(10) Patent No.: US 7,783,208 B2
(45) Date of Patent: Aug. 24, 2010

(54) IMAGE FORMING APPARATUS AND TONER CONSUMPTION AMOUNT CALCULATING METHOD

(75) Inventors: Toshiki Shiroki, Shiojiri (JP); Takatoshi Sugita, Shiojiri (JP); Isao Inaba, Shiojiri (JP); Hidenori Kin, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 864 days.

(21) Appl. No.: 11/550,341

(22) Filed: Oct. 17, 2006

(65) Prior Publication Data

US 2007/0092273 A1 Apr. 26, 2007

(30) Foreign Application Priority Data

Oct. 21, 2005 (JP) ..... 2005-307540

(51) Int. Cl.
*G03G 15/08* (2006.01)

(52) U.S. Cl. ..... 399/27

(58) Field of Classification Search ..... 399/27, 399/49

See application file for complete search history.

(56) References Cited

U.S. PATENT DOCUMENTS 5,349,377 A 9/1994 Gilliland et al. ..... 346/153.1

2006/0233559 A1* 10/2006 Sugita et al. ..... 399/27

FOREIGN PATENT DOCUMENTS

| | | |
|---|---|---|
| JP | 07-005766 | 1/1995 |
| JP | 2002-162800 | 6/2002 |
| JP | 2002-174929 | 6/2002 |

OTHER PUBLICATIONS

Japanese Published Unexamined Patent Application No. 7-5766 corresponds to U.S. Patent Application No. 5,349,377.

* cited by examiner

*Primary Examiner*—David M Gray
*Assistant Examiner*—Laura K Roth
(74) *Attorney, Agent, or Firm*—Hogan Lovells US LLP

(57) ABSTRACT

An image forming apparatus which forms an image using toner includes: a data processor which performs data processing of input image data corresponding to a toner color and accordingly generates output image data needed to obtain a predetermined tone reproduction characteristic; an image forming unit which forms an image corresponding to the output image data; and a toner consumption amount calculator which executes data selection for selecting one of the input image data and the output image data in accordance with a scheme of the data processing, sums up values of the selected image data, and calculates amount of toner consumed as an image is formed based on resulting integration value.

2 Claims, 11 Drawing Sheets

| CONTENT OF IMAGE | | COUNTER TO SELECT | IMAGE DATA TO SELECT |
|---|---|---|---|
| COLOR | | FIRST COUNTER | INPUT IMAGE DATA |
| MONOCHROME (BLACK) | TEXT | SECOND COUNTER | OUTPUT IMAGE DATA |
| | GRAYSCALE | FIRST COUNTER | INPUT IMAGE DATA |

IMAGE FORMING APPARATUS AND TONER CONSUMPTION AMOUNT CALCULATING METHOD

CROSS REFERENCE TO RELATED APPLICATION

The disclosure of Japanese Patent Application No. 2005-307540 filed on Oct. 21, 2005 including specification, drawings and claims is incorporated herein by reference in its entirety.

BACKGROUND

1. Technical Field

The present invention relates to a technique for calculating the amount of toner which is consumed as an image is formed by an image forming apparatus.

2. Related Art

An image forming apparatus of the electrophotographic type, such as a printer, a copier machine and a facsimile machine, which forms an image using toner must know, for the convenience of maintenance including replenishment of toner, a toner consumption amount or a remaining toner amount. In response to this, techniques for accurately calculating the amount of toner which is consumed as an image is formed have been proposed. For instance, according to the toner consumption amount detection method described in JP-A-2002-162800, the tone values of print dots expressed in multiple tones are summed up for one page, thus obtained integration value is multiplied by a predetermined coefficient and an offset amount which corresponds to the amount of toner which is consumed without contributing to image formation is added to the resultant value, whereby a toner consumption amount is calculated.

In general, an image forming apparatus of this type performs data processing of input image data to thereby obtain a predetermined image quality. Such data processing is executed for the purpose of controlling the density of an image eventually formed on a recording medium to a predetermined density. Meanwhile, it is known that there is a non-linear relativity between the amount of toner constituting an image and the density of the image. Due to this, a relationship between image data and the amount of toner constituting an image corresponding to the image data as well may be non-linear in some instances.

As for such instances where the conventional techniques above are used, since the tone value given to each print dot is an adjusted value so that a predetermined density will be obtained on a recording medium, the tone values of the print dots and a toner consumption amount are not always proportional considering the non-linearity described above. The conventional techniques above however have not taken this feature into consideration sufficiently, leaving a room for improvement with respect to the accuracy of calculating the toner consumption amount.

SUMMARY

An advantage of some aspects of the invention is to accurately calculate the amount of toner which is consumed as an image is formed in an image forming apparatus. Calculation of a toner consumption amount based on image data may be achieved by a method which requires accumulating pre-data processing input image data or a method which requires accumulating post-data processing output image data. Through comparison of the calculation accuracies of these two calculation methods, the inventors of the invention clearly found that there were instances where the former method attained a better accuracy and there were opposite instances. In other words, which one between input image data and output image data better express a toner consumption amount owing to its greater relativity to the toner consumption amount changes depending upon the content of an image which is formed. The inventors further found that it was possible to determine to a certain extent which calculation method was more accurate in accordance with the scheme of data processing for generating output image data. Noting this, an aspect of the calculation technique according to the invention requires selecting one of input image data and output image data in accordance with the scheme of data processing and calculating the toner consumption amount based on the selected data. This makes it possible to accurately calculate the toner consumption amount irrespective of the content of an image to form.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
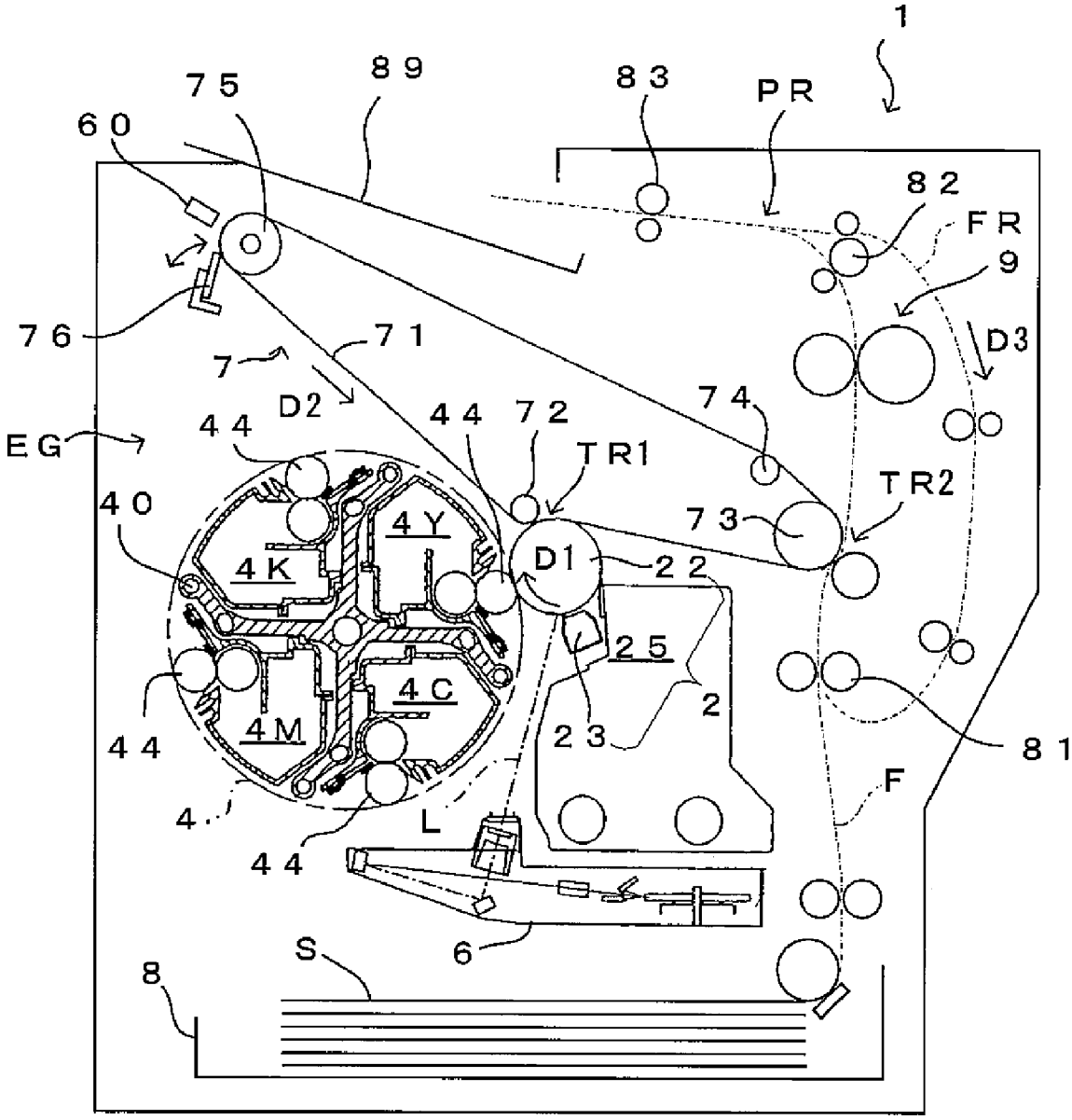
FIG. 1 is a drawing which shows an example of the structure of an image forming apparatus to which the invention is favorably applicable.
Figure 2:
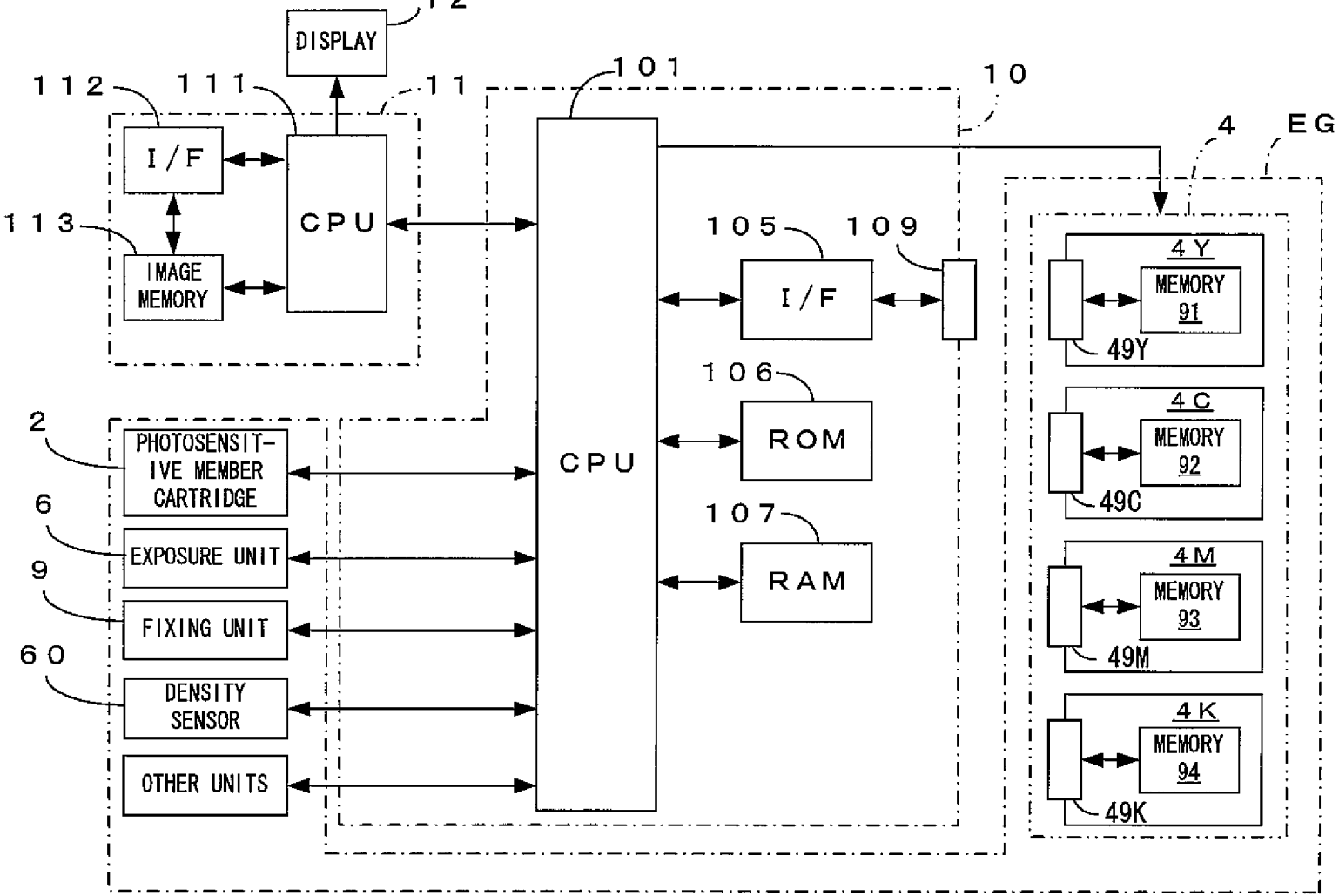
FIG. 2 is a block diagram of the electric structure of the image forming apparatus shown in FIG. 1.

FIG. 1 is a drawing which shows an example of the structure of an image forming apparatus to which the invention is favorably applicable. FIG. 2 is a block diagram of the electric structure of the image forming apparatus shown in FIG. 1. The illustrated apparatus 1 is an apparatus which overlays toner as developing agent in four colors of yellow (Y), cyan (C), magenta (M) and black (K) one atop the other and accordingly forms a full-color image, or forms a monochrome image using only black toner. In the image forming apparatus 1, when an image signal is fed to a main controller 11 from an external apparatus such as a host computer, an engine controller 10 performs a predetermined image forming operation in accordance with an instruction received from the main controller 11. The engine controller 10 controls respective portions of an engine part EG, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from a main section of the apparatus 1 as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

Non-volatile memories 91 through 94 which store information regarding the respective developers are disposed to the developers 4Y, 4C, 4M and 4K. As one of connectors 49Y, 49C, 49M and 49K disposed to the respective developers selected as needed is connected with a connector 109 which is disposed to the main section, a CPU 101 of the engine controller 10 and one of the memories 91 through 94 communicate with each other. In this manner, the information regarding the respective developers is transmitted to the CPU 101 and the information inside the respective memories 91 through 94 is updated and stored. The communication between the CPU 101 and the memories 91 through 94 is not limited in the mechanical contacting manner described above, and may be carried out in a non-contacting manner such as a radio communication for example.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the trailing end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there are a density sensor 60 and a cleaner 76 in the vicinity of the roller 75. The density sensor 60 optically detects a toner amount which constitutes a toner image which is formed as a patch image on the intermediate transfer belt 71 when needed. That is, the density sensor 60 irradiates light toward the patch image, receives reflection light from the patch image, and outputs a signal corresponding to a reflection light amount. The cleaner 76 can be attached to and detached from the intermediate transfer belt 71. When abutting on the intermediate transfer belt 71 as needed, the cleaner 76 scrapes off the toner remaining on the intermediate transfer belt 71.

Further, as shown in FIG. 2, the apparatus 1 comprises a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, etc.

In FIG. 2, denoted at 113 is an image memory which is disposed to the main controller 11, so as to store an image which is fed from an external apparatus such as a host computer via an interface 112. Denoted at 106 is a ROM which stores a calculation program executed by the CPU 101, control data for control of the engine part EG, etc. Denoted at 107 is a memory (RAM) which temporarily stores a calculation result derived by the CPU 101, other data, etc.

Figure 3:
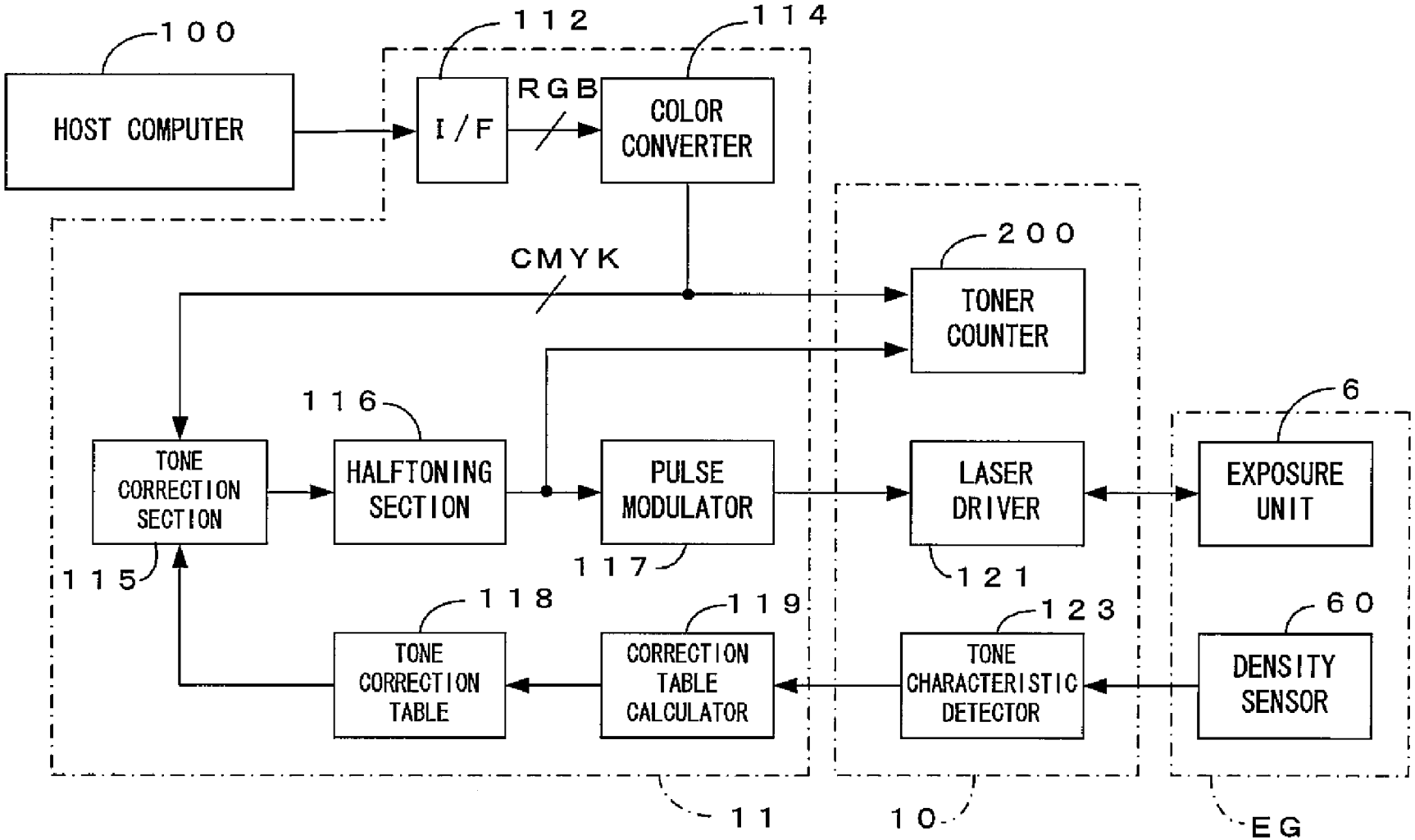
FIG. 3 is a diagram which shows signal processing blocks of the apparatus.

FIG. 3 is a diagram which shows signal processing blocks of the apparatus. In the image forming apparatus, when an image signal is inputted from an external apparatus such as a host computer 100, the main controller 11 performs a predetermined signal processing on the input image signal. The main controller 11 includes function blocks such as a color converter 114, a tone correction section 115, a half-toning section 116, a pulse modulator 117, a tone correction table 118, a correction table calculator 119.

In addition to the CPU 101, the ROM 106, and the RAM 107 shown in FIG. 2, the engine controller 10 further includes a laser driver 121 for driving a laser light source provided at the exposure unit 6, and a tone characteristic detector 123 for detecting a tone characteristic based on a detection result given by the density sensor 60, the tone characteristic representing a gamma characteristic of the engine EG.

In the main controller 11 and the engine controller 10, the function blocks may be implemented in hardware or otherwise, in software executed by the CPU 111, 101.

In the main controller 11 supplied with the image signal from the host computer 100, the color converter 114 converts RGB color data into CMYK color data, the RGB color data representing tone levels of RGB components of each pixel in an image corresponding to the image signal, the CMYK color data representing tone levels of CMYK components corresponding to the RGB components. In the color converter 114, the input RGB color data comprise 8 bits per color component for each pixel representing 256 tone levels, for example, whereas the output CMYK color data similarly comprise 8 bits per color component for each pixel representing 256 tone levels. The CMYK tone data outputted from the color converter 114 are inputted to the tone correction section 115.

The tone correction section 115 performs tone correction on the per-pixel CMYK data inputted from the color converter 114. Specifically, the tone correction section 115 refers to the tone correction table 118 previously stored in the nonvolatile memory, and converts the per-pixel CMYK data inputted from the color converter 114 into corrected CMYK data according to the tone correction table 118, the corrected CMYK data representing corrected tone levels. An object of the tone correction is to compensate for the variations of the gamma characteristic of the engine EG constructed as described above, thereby allowing the image forming apparatus to maintain the overall gamma characteristic thereof in an idealistic state at all times.

The half-toned CMYK tone data inputted to the pulse modulator 117 are represented by a multivalued signal which indicates respective sizes and arrays of CMYK toner dots, to which CMYK color toners are made to adhere and which constitute one pixel. Based on such half-toned CMYK tone data thus received, the pulse modulator 117 generates a video signal for pulse width modulation of an exposure laser pulse for forming each of CMYK color images, the exposure laser provided at the engine EG. Then, the resultant signal is outputted to the engine controller 10 via a video interface not shown. In response to the video signal, the laser driver 121 provides ON/OFF control of a semiconductor laser of the exposure unit 6 whereby an electrostatic latent image of each of the color components is formed on the photosensitive member 22. The image corresponding to the image signal is formed in this manner.

In the image forming apparatuses of this type, the gamma characteristic varies from apparatus to apparatus. Furthermore, the apparatus per se encounters the variations of the gamma characteristic thereof according to the use conditions thereof. In order to eliminate the influences of the varied gamma characteristics on the image quality, a tone control process is performed in a predetermined timing so as to update the contents of the tone correction table 118 based on measurement results of image density.

The tone control process is performed as follows. Toned patch images for tone correction, prepared for measurement of the gamma characteristic, are formed on the intermediate transfer belt 71 by means of the engine EG. A density of each of the toned patch images is detected by the density sensor 60. Based on signals from the density sensor 60, the tone characteristic detector 123 generates a tone characteristic, i.e. the gamma characteristic of the engine EG, which relate the individual tone levels of the toned patch images with the detected image densities. The resultant tone characteristic is outputted to the correction table calculator 119 of the main controller 11. The correction table calculator 119, in turn, operates tone correction table data based on the tone characteristic supplied from the tone characteristic detector 123. The tone correction table data are used for compensating for the measured tone characteristic of the engine EG in order to obtain an idealistic tone characteristic. Then, the correction table calculator 119 updates the tone correction table 118 to the operation results. The tone correction table 118 is redefined in this manner. Thus, the image forming apparatus is allowed to form images of a consistent quality regardless of the variations of the gamma characteristic thereof or the time-related variations thereof.

A description will now be given on the operation and the structure of the toner counter 200 which calculates the amount of toner which is consumed as an image is formed in the image forming apparatus which has the structure above. As shown in FIG. 3, in this image forming apparatus, the toner counter 200 is disposed in the engine controller 10.

The following two count techniques may be used to calculate based on image data a toner consumption amount through counting of the tone values of print dots which constitute an image. The first count technique requires counting image data as they are right after RGB-to-CMYK color conversion. Meanwhile, the second count technique requires counting image data as they are after various types of data processing, such as tone correction and halftoning, of color-converted image data. In the following, image data fed to the tone correction section 115 from the color converter 114 of the main controller 11 will be referred to as "input image data" while post-data processing image data which are output from the halftoning section 116 will be referred to as "output image data".

Of these two count techniques, with respect to the first count technique which requires counting input image data as they are right after color conversion, it has been heretofore considered difficult to improve the calculation accuracy due to introduction of the non-linearity from subsequent data processing, the gamma-characteristic of the apparatus or the like. In general, the second count technique which requires counting post-data processing output image data has therefore been used.

However, conducting experiments comparing computational toner consumption amounts calculated from counts based on image data representing various images with actually measured toner consumption amounts, the inventors found that depending upon the contents of the images, the calculation results according to the first count technique were closer to the actually measured values in some instances. Describing this in more specific details, the second count technique gives a better accuracy on an image which is mainly formed by lines, e.g., a text, a chart, a table, etc., whereas the first count technique gives a better accuracy on an image such as a photograph and an illustration which heavily uses middle tones.

It then follows that parallel use of the first and the second count techniques, i.e., counting while appropriately switching between these depending upon the situation, is expected to further improve the accuracy of calculating a toner consumption amount. In light of this, the toner counter 200 according to the invention is structured to receive both input image data as they are right after color conversion and output image data as they are after tone correction and halftoning, select one of these image data depending upon the situation and execute multiplication.

Figure 4:
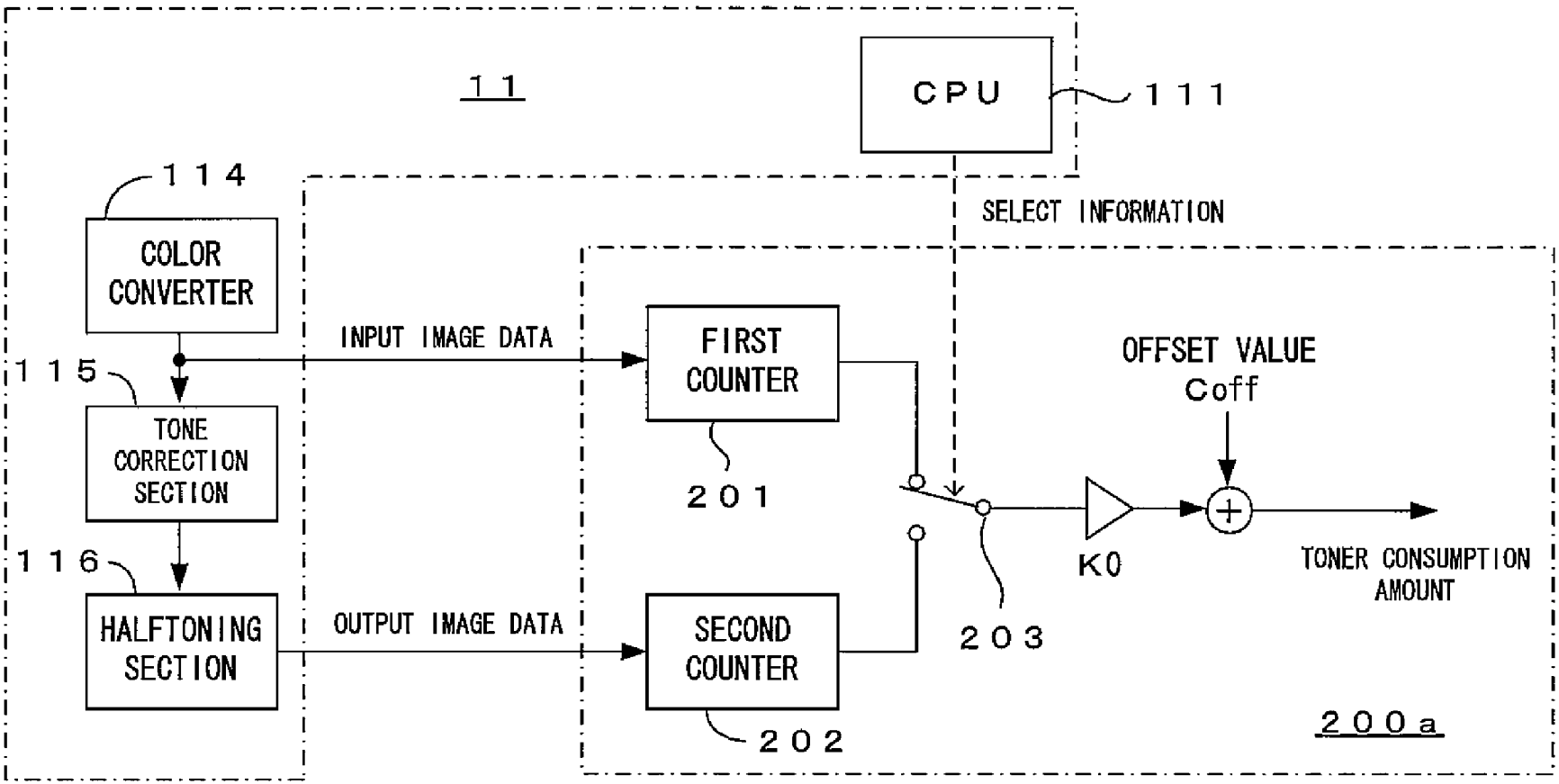
FIG. 4 is a drawing which illustrates the structure of the toner counter according to the first embodiment of the invention.

FIG. 4 is a drawing which illustrates the structure of the toner counter according to the first embodiment of the invention. The illustrated toner counter 200*a*, which is the first embodiment of the toner counter 200 shown in FIG. 3, comprises a first counter 201 which receives input image data which are fed to the tone correction section 115 from the color converter 114 of the main controller 11 and a second counter 202 which receives output image data which are output from the halftoning section 116. Each one of the counters 201 and 202 sums up the tone values of print dots expressed by the image data which have been input and accordingly yields a count. That is, the first counter 201 sums up the tone values of the respective print dots expressed by the input image data as they are right after color conversion, and accordingly yields a count. The second counter 202 sums up the tone values of the respective print dots expressed by the output image data as they are after tone correction and halftoning, and accordingly yields a count. Upon summation of the data amounting to one page of image, the both counters output the integration values which they have stored in themselves.

The outputs from the first and the second counters 201 and 202 are each connected to a select switch 203. The select switch 203, based on select information fed from the CPU 111 of the main controller 11, selects one of the outputs from the first and the second counters. The selected counter output, or integration value, is multiplied by a predetermined coefficient K0 which corresponds to the rate of adhering toner per tone value. The result is a value which corresponds to the toner consumption amount for one page of image. A predetermined offset value Coff is added to this value.

The offset value Coff is a value which corresponds to the amount of toner which is consumed without contributing to formation of an image which corresponds to the fed image data. Such toner includes toner falling off from the developing roller 44, adhering to the photosensitive member 22 and accordingly causing fogging, toner which gets splashed inside the apparatus, toner which is consumed inside the apparatus during a control operation which aims at maintaining the capability of the apparatus, etc. Toner which is consumed as the various patch images according to the embodiment are formed is also included in such toner. As the amount of toner which is consumed in this manner is related to the operating time of the apparatus, the number of images formed, the operating conditions for the apparatus and the like, the toner consumption amount during this period is estimated as the offset value Coff, based on these information which the engine controller 10 controls. The sum of this offset value and the toner consumption amount corresponding to the image data is used as the toner consumption amount in the apparatus as a whole.

It is the CPU 101 disposed within the engine controller 10 that manages thus calculated toner consumption amount, and the RAM 107 or the memories 91 and the like of the respective developers 4Y and the like store this toner consumption amount when necessary. It is also possible to estimate the remaining toner amounts within the respective developers from thus calculated toner consumption amount, which is useful to management of the consumables for the apparatus: in the event that it is determined that the remaining toner amount within a certain developer has decreased below a predetermined value, the display 12 may show a message requesting for exchange of this developer.

The select information fed from the CPU 111 to the toner counter 200*a* will now be described. Based on the content of the data processing in the main controller 11, the CPU 111 determines whether to select the output from one of the counters, and provides the select switch 203 with the result as the select information. In this embodiment, the counter output is chosen in accordance with the type of a screen for screening executed by the halftoning section 116.

Figures 5, 6:
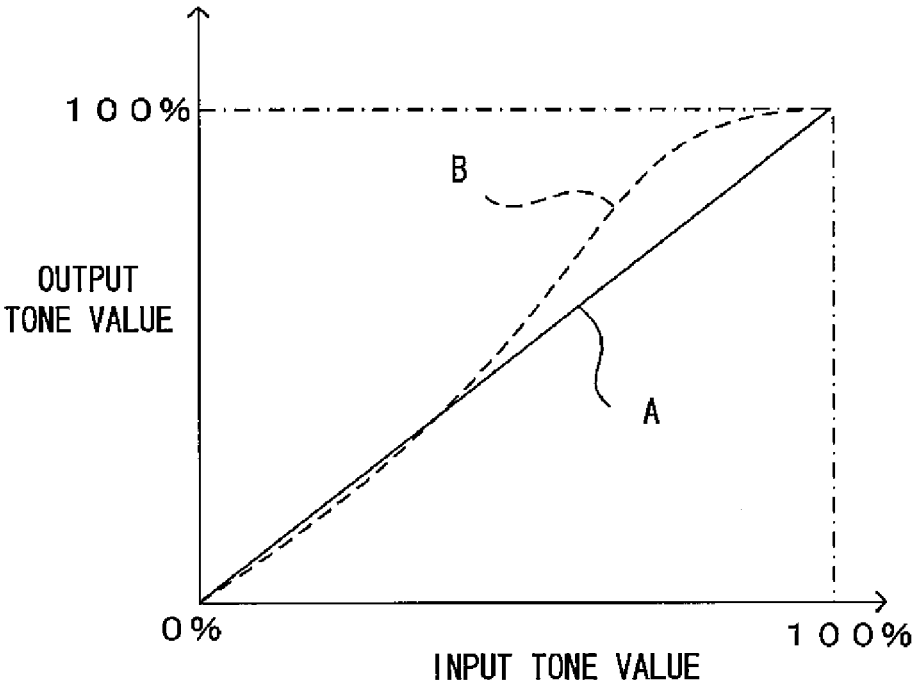
FIG. 5 is a drawing which shows a difference in terms of tone reproduction characteristic between two types of screens.
FIG. 6 is a drawing which shows the content of the select information.

FIG. 5 is a drawing which shows a difference in terms of tone reproduction characteristic between two types of screens. When an image to form is a photograph, an illustration or the like, since the reproducibility of middle tones is important, the halftoning section 116 uses a tone-oriented screen which realizes an almost linear relationship between input tone values and output tone values as denoted at the curve A in FIG. 5. In such an instance, a toner consumption amount is approximately proportional to an input tone value.

On the contrary, for an image of a text, a chart, a table, etc., as denoted at the curve B in FIG. 5, a resolution-oriented screen is chosen which puts the priority upon the resolution and greatly enhances the contrast of the image. Where the resolution-oriented screen denoted at the curve B in FIG. 5 is used, a toner consumption amount tends to increase on the higher tone value side.

FIG. 6 is a drawing which shows the content of the select information. In this image forming apparatus, when an image to form is a color image, the tone-oriented screen is used for screening of image data in each toner color. This is because it is often a photograph image or the like that needs the full range of colors, and even with respect to an image which is mainly a text, the reproducibility of middle tones is important for precise color representation. Meanwhile, when an image to form is a monochrome image in black, the image is often an image which is mainly a text, and therefore, the resolution-oriented screen described above is used. In limited situations however that the image formation command provided from outside the apparatus contains designation that this image must be a grayscale image, the resolution-oriented screen is used.

The CPU 111 thus outputs the select information which is suitable to the chosen screen. In other words, as shown in FIG. 6, the CPU 111 outputs the select information which requires selecting the output from the first counter 201, when an image to form is a color image. This remains the same when an image to form is a monochrome image and there is grayscale designation. On the contrary, when an image to form is a monochrome image and there is no grayscale designation, the CPU 111 outputs the select information which requires selecting the output from the second counter 202.

As a result, when a color image is desired or when a monochrome image is desired with grayscale designation, a toner consumption amount is calculated based on the input image data as they are right after color conversion. In contrast, as for a monochrome image without any grayscale designation, a toner consumption amount is calculated based on the output image data as they are after tone correction and halftoning. This embodiment, requiring selecting and summing up one of these two image data in accordance with the scheme of the data processing, achieves accurate calculation of a toner consumption amount. To be more specific, which data to use is selected depending upon whether an image is processed as a color image or a monochrome image or depending upon the type of the screen to use.

As input tone values and output tone values are approximately proportional as denoted at the curve A in FIG. 5 when the resolution-oriented screen is chosen, one may believe that selecting the output from the second counter 202 would be reasonable. This however is not desirable. The reason is because the tone correction characteristic, which aims at compensating the gamma-characteristic of the apparatus, has already been added to post-data processing output image data. In short, in this apparatus, the gamma-characteristic of the apparatus and the tone correction characteristic provided from the tone correction section 115 cancel out each other, which prevents the gamma-characteristic of the apparatus from influencing the quality of an image. The correction characteristic of this nature is an excessive characteristic from the viewpoint of toner consumption amount calculation, and could deteriorate the calculation accuracy.

Other method of selecting the outputs from the two counters within the toner counter 200*a* shown in FIG. 4 will now be described. This method is a suitable method to where the gamma-characteristic of the apparatus is greatly uneven or variations with time are significant. As described earlier, in an attempt to compensate the gamma-characteristic of the apparatus, this image forming apparatus forms tone patch images and detects their densities. Tone patch images are images which are formed while a tone value is changed over multiple levels. As the detected image densities are plotted against the tone values, a characteristic curve corresponding to the gamma-characteristic of the apparatus is obtained.

Figure 7:
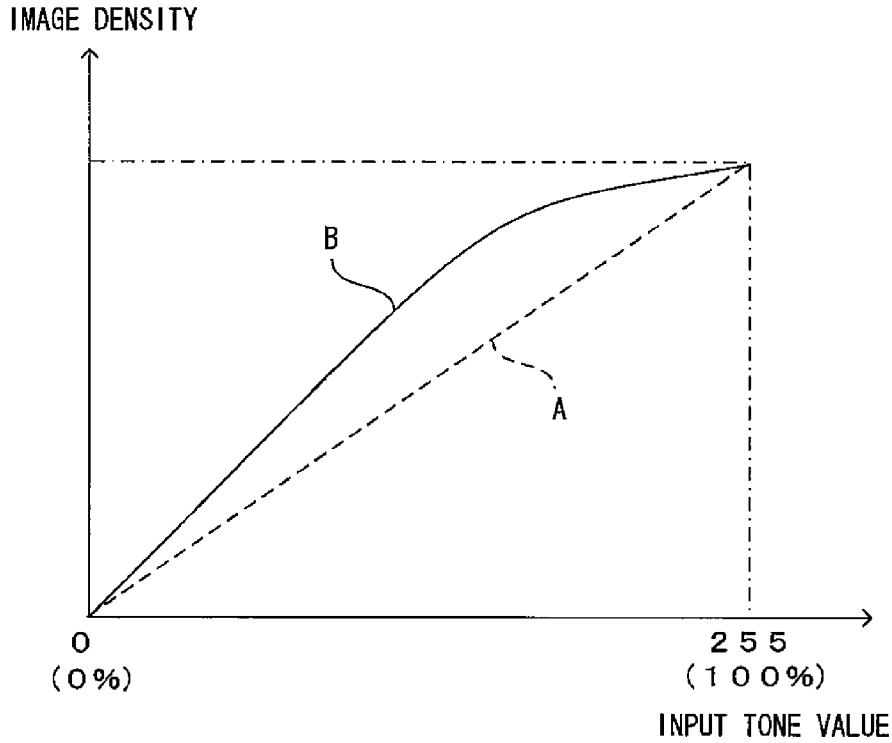
FIG. 7 is a drawing which shows an example of the gamma-characteristic.

FIG. 7 is a drawing which shows an example of the gamma-characteristic. As denoted at the curve A in FIG. 7, in an apparatus having an approximately linear gamma-characteristic, an approximately linear relationship seems to exist between output image data and a toner consumption amount. Hence, it is possible to calculate a toner consumption amount from output image data in such an instance. On the contrary, in the event that the gamma-characteristic is remarkably off a linear curve as denoted at the curve B, a significant discrepancy is suspected between output image data and a toner consumption amount. In such an instance, it is preferable to calculate a toner consumption amount from input image data.

Figure 8:
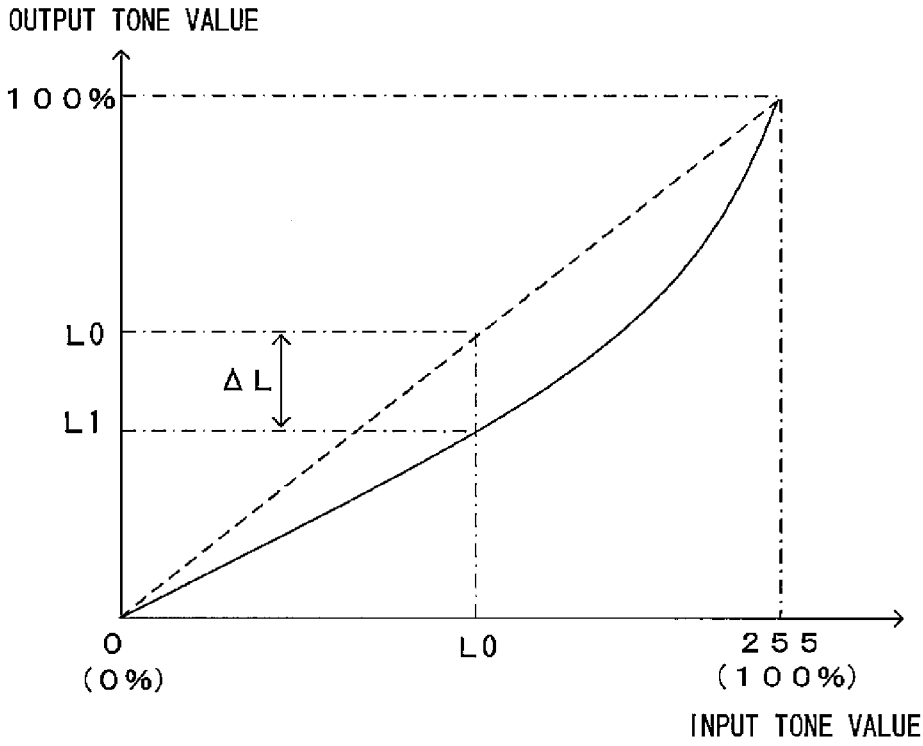
FIG. 8 is a drawing which shows an example of the tone correction characteristic.

FIG. 8 is a drawing which shows an example of the tone correction characteristic. For compensation of the gamma-characteristic of the apparatus, the tone correction section 115 secures a tone correction characteristic which shows a relationship as that denoted at the solid line in FIG. 8 between input tone values and output tone values. More linear the gamma-characteristic of the apparatus is relative to the tone value of data, more linear the tone correction characteristic is. Hence, comparison of the image data before tone correction with the image data after tone correction makes it possible to estimate the degree of the deviation of the gamma-characteristic from a linear curve. That is, when a difference ΔL between a certain input tone value L0 and a corresponding output tone value L1 is small, the gamma-characteristic winds only a little, whereas when this value ΔL is large, the gamma-characteristic winds and deviates greatly from the linear curve.

Noting this, when the value ΔL is smaller than a predetermined value, the CPU 111 ensures that the output from the second counter 202, which counts output image data, is selected from among the two counters disposed within the toner counter 200*a*. On the contrary, when the value ΔL is larger than a predetermined value, the output from the first counter 201, which counts input image data, is selected. It is possible to accurately calculate a toner consumption amount by this method as well.

By the way, an image forming apparatus of this type is accompanied with the phenomenon that as the amount of toner constituting an image grows to or beyond a certain level, despite a further increase of the toner amount, the density of the image does not increase very much.

Figure 9:
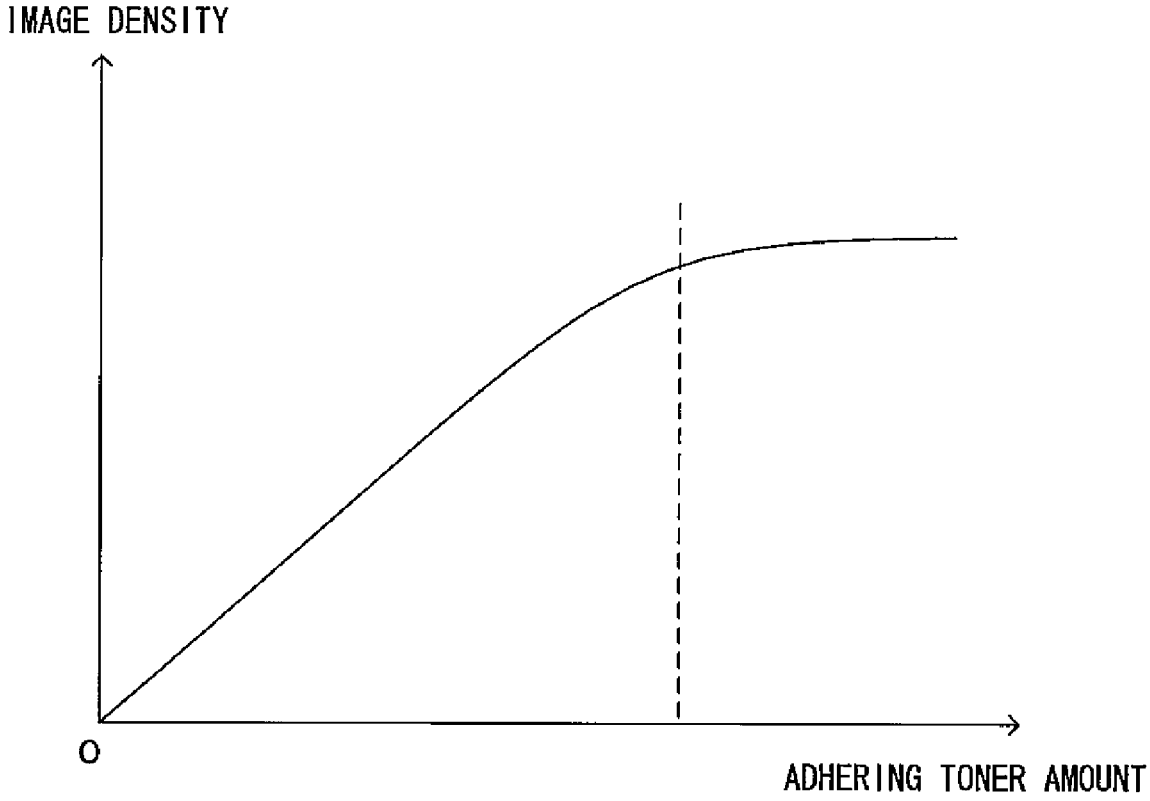
FIG. 9 is a drawing of a relationship between an adhering toner amount and an image density.

FIG. 9 is a drawing of a relationship between an adhering toner amount and an image density. To be exact, this is a drawing which shows a relationship between the amount of adhering toner upon transfer of an image onto the sheet S and the density of the image. As shown in FIG. 9, while the image density increases in proportion to the adhering toner amount as the adhering toner amount increases, the growth of the image density slows down when the adhering toner amount exceeds a certain level, and the image density flats out eventually and scarcely changes. This is because as the surface of the sheet S is covered with toner, the image density in this section becomes almost equal to the hue of the toner and will not increase even despite a further increase of the toner amount. This means that in a region where the tone value is particularly high, the increase of the image density in response to the increase of the tone value becomes small.

Performing tone correction and halftoning in light of this feature, this image forming apparatus maintains a constant relativity between input image data and a final image density. In other words, the output image data from the halftoning section 116 is generated under the influence of the characteristic shown in FIG. 9. It is therefore unnecessary to take the characteristic shown in FIG. 9 into consideration, as long as the integration value of the output image data is used. On the contrary, for calculation of the toner consumption amount through summation of the input image data, it is preferable to take the characteristic shown in FIG. 9 into consideration. That is, correction considering the characteristic shown in FIG. 9 is preferable for calculation of a toner consumption amount through summation of the input image data. A toner counter 200*b*, which is the second embodiment of the toner counter 200, described below takes this into consideration.

Figure 10:
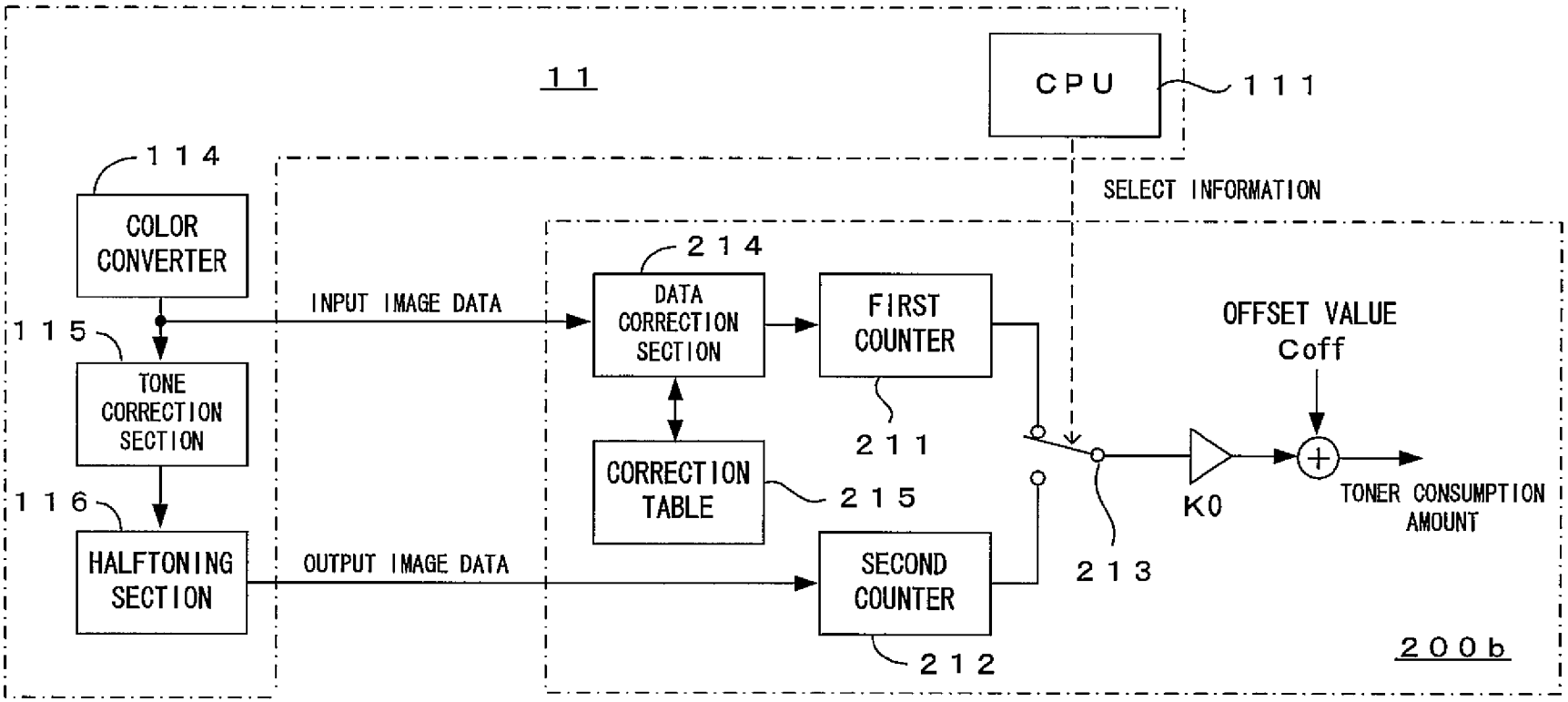
FIG. 10 is a drawing which shows the structure of the toner counter according to the second embodiment of the invention.

FIG. 10 is a drawing which shows the structure of the toner counter according to the second embodiment of the invention. The illustrated toner counter 200*b* is different from the toner counter 200*a*, i.e., the first embodiment, in that the input image data from the color converter 114 of the main controller 11 are fed to a first counter 211 via a data correction section 214 storing a correction table 215. The structure is otherwise basically the same. That is, the first counter 211, a second counter 212 and a select switch 213 respectively correspond to the first counter 201, the second counter 202 and the select switch 203 of the toner counter 200*a* which is the first embodiment, and respectively have equivalent functions to those of the corresponding structures of the first embodiment.

Figure 11:
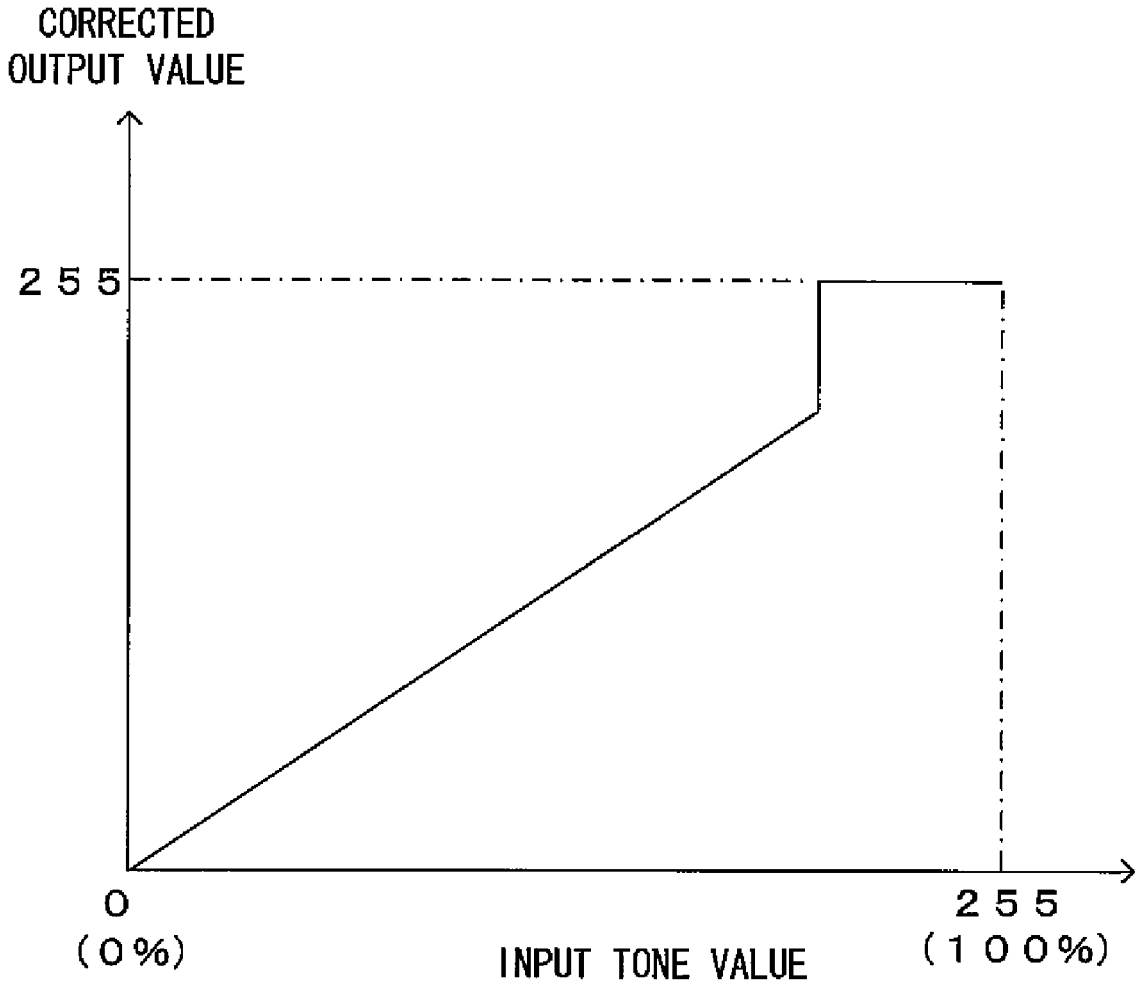
FIG. 11 is a drawing which shows an example of the correction characteristic of the correction table.

FIG. 11 is a drawing which shows an example of the correction characteristic of the correction table. From the characteristic shown in FIG. 9, it is seen that an increase of the tone value becomes small in the high tone value region. When data processing is executed so as to compensate this and increase the density of an image in response to a tone value, a toner consumption amount becomes large particularly in the high tone value region. The characteristic shown in FIG. 11 schematically expresses this, and this characteristic is saved as a table in the data correction section 214. The data correction section 214, while referring to the correction table 215 in response to the input image data which it receives, forcibly corrects an output value to a maximum value (which is 100%, or 255) when the input image data have a certain tone value or a larger value, thereby factoring an increase of the toner consumption amount in the high tone value region into calculation. This further improves the calculation accuracy of a toner consumption amount based on the input image data.

The toner counter according to the third embodiment of the invention will now be described. The toner counters of the first and the second embodiments above select the two counter outputs based on the select information fed from the CPU 111 depending upon the content of the data processing within the main controller 11. In contrast, the third embodiment of the toner counter described below selects the two counter outputs based on the result of analysis of the output image data which are output from the halftoning section 116 and estimation of the content of the data processing within the main controller 11.

Figure 12:
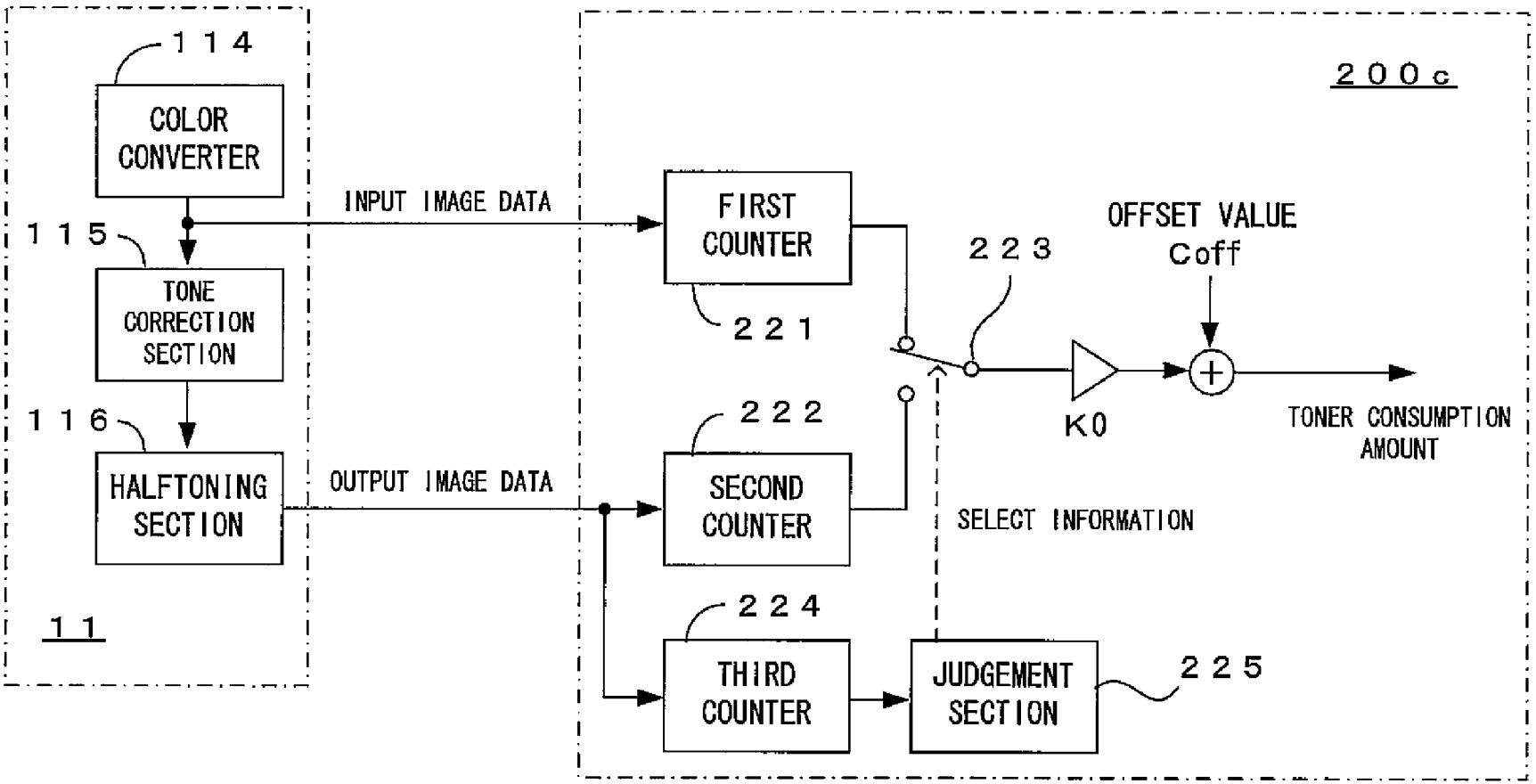
FIG. 12 is a drawing which illustrates the third embodiment of the toner counter according to the invention.

FIG. 12 is a drawing which illustrates the third embodiment of the toner counter according to the invention. The toner counter 200*c* of the third embodiment as well comprises a first counter 221, a second counter 222 and a select switch 223. These functions are the same as those of the corresponding structures of the first embodiment. The toner counter 200*c* of this embodiment further comprises a third counter 224 which receives the output image data which are output from the halftoning section 116 and a judgment section 225 which receives an output from the third counter 224 and outputs the select information to the select switch 223.

The third counter 224, unlike the second counter 222 which sums up the tone values of print dots expressed by the output image data, counts those dots having a predetermined tone value from among the print dots expressed by the output image data. In this embodiment, of print dots contained in one page of image, the number of those whose tone values are within the range of 10% to 90% is counted. Receiving the output from the third counter 224, the judgment section 225 determines the frequency of occurrence of those dots whose tone values belong to this range. The frequency of occurrence may be defined as the number of print dots falling under the range above relative to the number of all print dots including those whose tone values are zero, or as the number of print dots falling under the range above relative to the number of all print dots exclusive of those whose tone values are zero. The latter definition is more preferable.

Figure 13A:
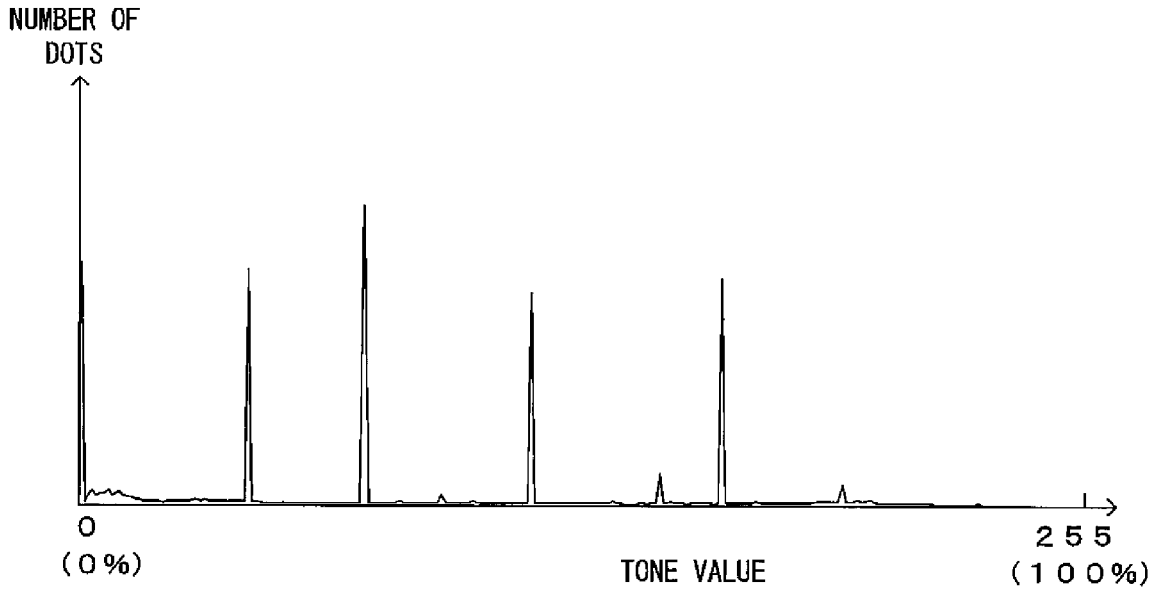
FIG. 13A and FIG. 13B are drawings which show a relationship between the content of an image and the number of print dots relative to each tone value.
Figure 13B:
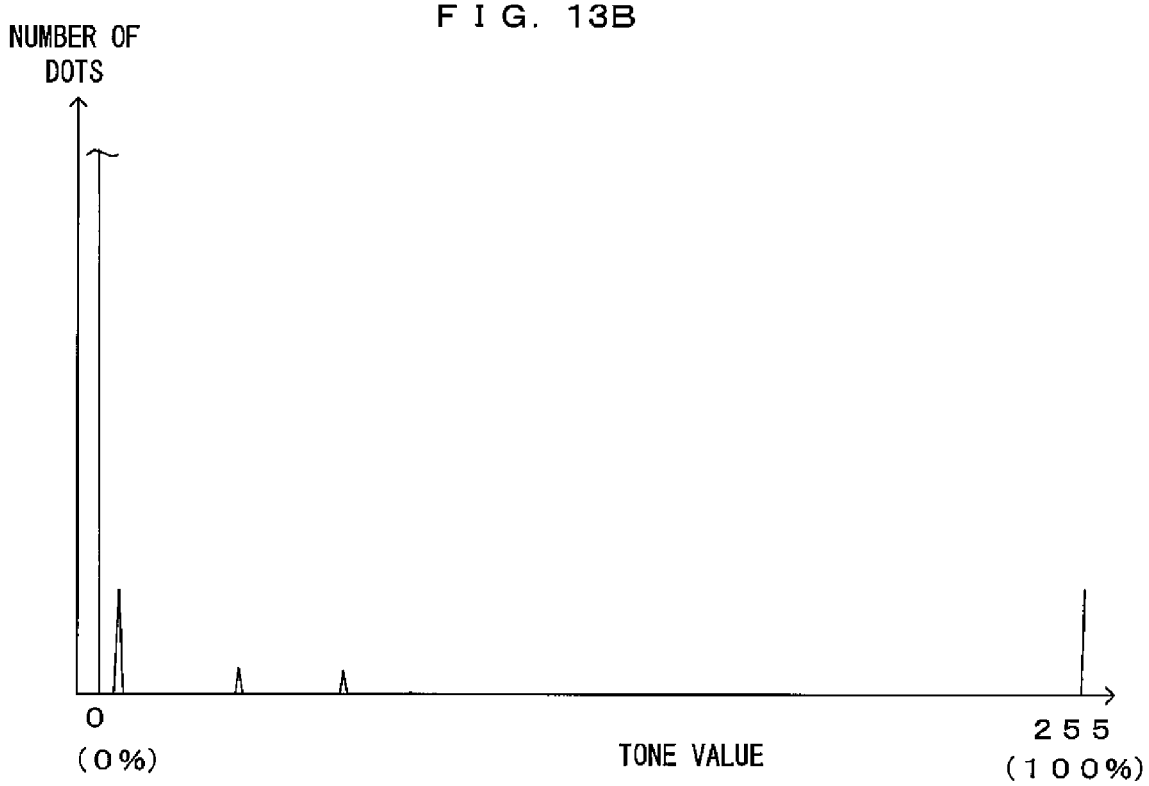

FIG. 13A and FIG. 13B are drawings which show a relationship between the content of an image and the number of print dots relative to each tone value. In the case of an image of a photograph, an illustration or the like, as one example in FIG. 13A shows, there are many print dots whose tone values are middle tone values and the frequency of occurrence of print dots having the maximum tone value (100%) is low. On the contrary, in the case of an image which is mainly formed by lines, e.g., a text, a chart, a table, etc., as shown in FIG. 13B, there are many print dots having the maximum tone value (100%) and also many print dots having the tone value of zero but the number of print dots having middle tone values is small. This difference is attributable to the fact that original image data per se have such a dot composition and to execution of data processing using a screen which is suitable to the content of the image.

It is therefore possible to estimate what kind of data processing has produced this image, from the distribution of the tone values of the print dots contained in the output image data. The judgment section 225 in this embodiment is structured so that the select switch 223 receives the select information demanding selection of the first counter 221 when the frequency of occurrence of print dots whose tone values range from 10% to 90% is larger than a predetermined value but receives the select information demanding selection of the second counter 222 when the frequency of occurrence is smaller than a predetermined value. This makes it possible to choose the counters depending upon the content of data and accurately calculate a toner consumption amount as in the embodiments described earlier.

The foregoing has described that it is preferable to exclude those dots having the tone value of zero from the total dot count in calculating the frequency of occurrence of print dots. This aims at avoiding an erroneous judgment caused by inclusion of a blank section, namely, a section which corresponds to the background of an image. Even where a photographic image is to be formed, if this image is to be located in a certain part only within one page, there is a wide blank area exclusive of the image area, i.e., a wide area occupied only by those dots having the tone value of zero. Removal of such an area permits judging only on an effective image area, which in turn reduces the probability of an erroneous judgment.

As described above, in each one of the embodiments described above, the input image data as they are right after color conversion and the output image data as they are after tone correction and halftoning are each summed up and counted separately, one of these count values is selected depending upon the content of the data processing which was performed to obtain the output image data from the input image data, and a toner consumption amount is calculated based on the selected integration value. In these embodiments, it is possible in this manner to accurately calculate the amount of toner consumed as an image is formed.

Selection from among the two count values may be made in accordance with the content of an image to form, i.e. color or monochrome, the type of a screen to use, the detected densities of patch images, or the like for instance. These information is information which is understandably necessary for control of the apparatus, and selecting the counter based on such information is therefore convenient to simplification of the processing. Further, it is possible to select the count value based on the result of analysis of the content of the image data.

As described above, in each one of the embodiments described above, of the respective processing blocks of the main controller 11, the tone correction section 115 and the halftoning section 116 function as the "data processor" of the invention. Meanwhile, the engine part EG functions as the "image forming unit" of the invention. Further, in the embodiments described above, the toner counters 200*a*, 200*b* and 200*c* each function as the "toner consumption amount calculator" of the invention. In addition, in the embodiments described above, the color-converted image data which are output from the color converter 114 correspond to the "input image data" of the invention, while the image data which are output from the halftoning section 116 correspond to the "output image data" of the invention.

The invention is not limited to the embodiments described above but may be modified in various manners in addition to the embodiments above, to the extent not deviating from the object of the invention. For instance, the respective embodiments above require receiving RGB image data from a host computer and calculating a toner consumption amount based on image data obtained by color conversion into the CMYK toner colors. However, in the event that image data corresponding to the toner colors are sent from the beginning, e.g., upon transmission of only such image data which correspond to a monochrome image in black, the image data may of course be used immediately for calculation of a toner consumption amount without color conversion.

Further, although the embodiments described above require calculating a toner consumption amount per page of image, this is not limiting. A toner consumption amount may be calculated in the units of jobs or even finer units of blocks which are divided sections of one page, for example.

Further, although the embodiments described above require disposing the counters which individually count the input image data and the output image data separately from each other, then selecting one of the values output from them and using the selected value for calculation of a toner consumption amount, the image data may be selected at the input side of the counters.

Further, although the first embodiment described above uses the two types of screens, the types, the number and the like of the screens are not limited to this but may be determined freely.

Further, although the third embodiment described above requires selecting from among the counters in accordance with the frequency of occurrence of dots whose tone values range from 10% to 90%, the counters may be chosen in accordance with other criterion which may for instance be the frequency of occurrence of dots having the maximum tone value of 100%.

The structures according to the embodiments described above are not limiting. The invention is applicable also to apparatuses which comprise developers for the black toner color alone and form monochrome images, apparatuses which comprise other transfer media, for example, transfer drums, transfer sheets, etc. than intermediate transfer belts, and further, to other image forming apparatuses such as copier machines and facsimile machines.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus which forms an image using toner, comprising:

a data processor which performs data processing of input image data corresponding to a toner color and accordingly generates output image data needed to obtain a predetermined tone reproduction characteristic;

an image forming unit which forms an image corresponding to the output image data; and a toner consumption amount calculator which executes data selection for selecting image data between the input image data inputted to the data processor and the output image data generated by the data processor in accordance with a scheme of the data processing, sums up values of the selected image data, and calculates amount of toner consumed as an image is formed based on resulting integration value, wherein a color image forming node for superimposing plural toner images of mutually different toner colors one atop the other and forming a color image and a monochrome image forming mode for forming a monochrome image consisting of a single-color toner image are selectively executed, the data processor executes the data processing of different schemes between the color image forming mode and the monochrome image forming mode, and the toner consumption amount calculator executes the data selection in accordance with which one of the color image forming mode and the monochrome image forming mode the output image data correspond to.

2. The image forming apparatus of claim 1, wherein the toner consumption amount calculator selects the input image data when the output image data correspond to the color image forming mode but selects the output image data when the output image data correspond to the monochrome image forming mode.

* * * * *